US010968546B2

(12) United States Patent
Michaels et al.

(10) Patent No.: US 10,968,546 B2
(45) Date of Patent: Apr. 6, 2021

(54) HYBRID TWISTED CORD

(71) Applicant: Firestone Fibers & Textiles Company, LLC, Kings Mountain, NC (US)

(72) Inventors: Tina G. Michaels, Gastonia, NC (US); Martin M. Luebbers, Lake Wylie, SC (US); John M. Hyleman, Bessemer City, NC (US)

(73) Assignee: Firestone Fibers & Textiles Company, LLC, Kings Mountain, NC (US)

( * ) Notice: Subject to any disclaimer, the term of this patent is extended or adjusted under 35 U.S.C. 154(b) by 108 days.

(21) Appl. No.: 16/340,233

(22) PCT Filed: Oct. 11, 2017

(86) PCT No.: PCT/US2017/056083

§ 371 (c)(1),
(2) Date: Apr. 8, 2019

(87) PCT Pub. No.: WO2018/075305

PCT Pub. Date: Apr. 26, 2018

(65) Prior Publication Data

US 2020/0040524 A1 Feb. 6, 2020

Related U.S. Application Data

(60) Provisional application No. 62/409,910, filed on Oct. 19, 2016.

(51) Int. Cl.
*D02G 3/48* (2006.01)
*D02G 3/04* (2006.01)
(Continued)

(52) U.S. Cl.
CPC ..... *D02G 3/48* (2013.01); *D02G 3/045* (2013.01); *D02G 3/047* (2013.01); *D02G 3/26* (2013.01);
(Continued)

(58) Field of Classification Search
CPC ..... D02G 3/045; D02G 3/047; D02G 3/26; D02G 3/28; D02G 3/48; D10B 2331/021
See application file for complete search history.

(56) References Cited

U.S. PATENT DOCUMENTS 4,155,394 A 5/1979 Bhakuni et al.
6,601,378 B1 8/2003 Fritsch et al.
(Continued)

FOREIGN PATENT DOCUMENTS

CN 101200161 6/2008
CN 101200827 6/2008
(Continued)

OTHER PUBLICATIONS

European Search Report; Corresponding European Application No. EP17862511; dated Jul. 2, 2020.
(Continued)

*Primary Examiner* — Shaun R Hurley
(74) *Attorney, Agent, or Firm* — Shaun J. Fox; Bryan J. Jaketic

(57) ABSTRACT

A hybrid fiber cord includes a first yarn and a second yarn. The first yarn has a first ply length, a first twist number, and a first elongation at break. The second yarn has a second length greater than the first length, a second twist number, and a second elongation at break that is less than the first elongation at break. The first yarn and the second yarn have the same cord twist. The hybrid fiber cord has a third elongation at break that is greater than the second elongation at break.

17 Claims, 3 Drawing Sheets

(51) Int. Cl.
*D02G 3/26* (2006.01)
*D02G 3/28* (2006.01)
*D03D 19/00* (2006.01)

(52) U.S. Cl.
CPC ..... *D02G 3/28* (2013.01); *D03D 19/00* (2013.01); *D10B 2331/021* (2013.01)

(56) References Cited

U.S. PATENT DOCUMENTS

| | | | | |
|---|---|---|---|---|
| 7,051,507 | B2 * | 5/2006 | Fritsch | D02G 3/28 57/314 |
| 8,376,009 | B2 | 2/2013 | Harikae et al. | |
| 8,794,283 | B2 | 8/2014 | Mori | |
| 9,175,425 | B2 * | 11/2015 | Love | F16L 11/02 |
| 9,789,731 | B2 * | 10/2017 | Lee | D02G 3/404 |
| 2003/0226612 | A1 | 12/2003 | Zhu et al. | |
| 2003/0228821 | A1 | 12/2003 | Zhu et al. | |
| 2004/0065072 | A1 | 4/2004 | Zhu et al. | |
| 2009/0090447 | A1 | 4/2009 | Baldwin et al. | |
| 2012/0097311 | A1 | 4/2012 | Ueyoko | |
| 2013/0025758 | A1 | 1/2013 | Kim | |
| 2013/0146200 | A1 | 6/2013 | Westgate et al. | |
| 2013/0167503 | A1 | 7/2013 | Han et al. | |
| 2013/0239539 | A1 | 9/2013 | Li et al. | |
| 2014/0237983 | A1 | 8/2014 | Love et al. | |
| 2014/0238524 | A1 | 8/2014 | Love et al. | |
| 2014/0345772 | A1 | 11/2014 | Assaad et al. | |
| 2015/0292124 | A1 * | 10/2015 | Lee | D02G 3/047 57/255 |
| 2016/0376733 | A1 * | 12/2016 | Jeon | B29D 30/70 57/237 |
| 2017/0106698 | A1 * | 4/2017 | Jeon | D02G 3/047 |

FOREIGN PATENT DOCUMENTS

| | | | | |
|---|---|---|---|---|
| CN | 201472078 | | 5/2010 | |
| CN | 102080286 | | 6/2013 | |
| DE | 102008037615 | A1 | 6/2010 | |
| EP | 3006228 | A1 * | 4/2016 | D02G 3/48 |
| JP | H03337 | A | 1/1991 | |
| KR | 100245520 | B1 | 3/2000 | |
| KR | 20060126101 | A | 12/2006 | |
| KR | 20120057247 | A | 6/2012 | |
| KR | 101602605 | | 3/2016 | |
| WO | 2001018291 | | 3/2001 | |
| WO | 2014104680 | A1 | 7/2014 | |

OTHER PUBLICATIONS

European Search Report—Written Opinion; Corresponding European Application No. EP17862511; dated Jul. 2, 2020.

International Search Report and Written Opinion; Corresponding PCT Application No. PCT/US2017/056083; dated Jan. 22, 2018.

Ayse Ayta et al.; Nylon 66/polyester hybrid cords: 1. Design and investigation of properties; Fibers and Polymers Apr. 2011, vol. 12, Issue 2, pp. 252-257; Publisher: The Korean Fiber Society.

Ayse Ayta et al.; Fatigue Properties of Nylon 66/Polyester Hybrid Cords; Rubber Chemistry and Technology: Dec. 2011, vol. 84, No. 4, pp. 482-492.

Lee, D. et al.; Nylon/Aramid Hybrid Cord in Earthmover Tire Applications; Kautschuk und Gummi, Kunststoffe, v 39, n 12, p. 1195-1197, Dec. 1986.

Barron, E.R.; Hybrid Tire Cords Containing Kevlar Aramid; Kautschuk und Gummi, Kunststoffe, v 40, n 2, p. 130-135, Feb. 1987.

* cited by examiner

HYBRID TWISTED CORD

FIELD OF INVENTION

This disclosure relates to the field of fiber cords and methods of manufacturing the same. More particularly, this disclosure relates to hybrid fiber cords, such as a cord having a nylon yarn and an aramid yarn.

BACKGROUND

Fiber cords are known to be used as reinforcements for rubber products such as tires, conveyor belts, hoses, and other items. Such fiber cords may be treated with adhesive, and may include nylon, polyester, rayon, and other natural and synthetic materials. Nylon is often used because it is relatively inexpensive, has a high adhesiveness before and after fatigue, and has desirable elongation properties. However, nylon also has lower strength and higher changeability between room temperature and high temperature than may be desired for certain applications.

By contrast, aramid fibers, such as KEVLAR, have lower shrinkage stress than nylon, good creep property and a high modulus. Aramid fibers are also known to have high strength but low elongation properties. To compensate for these properties, hybrid structures have been developed that include both nylon and aramid. In such structures, different twist numbers are employed for the nylon and aramid ply yarns. Using different twist numbers can result in high variability of the physical properties.

SUMMARY OF THE INVENTION

In one embodiment, a hybrid fiber cord includes a nylon yarn and an aramid yarn. The nylon yarn has a first length, a first twist number, and a first elongation at break. The aramid yarn has a second length greater than the first length, a second twist number, and a second elongation at break that is less than the first elongation at break. The nylon yarn and aramid yarn have the same cord twist. The second length is between 105% and 120% of the first length. The hybrid fiber cord has a third elongation at break that is greater than the second elongation at break.

In another embodiment, a hybrid fiber cord includes a first yarn and a second yarn. The first yarn has a first ply length, a first twist number, and a first elongation at break. The second yarn has a second length greater than the first length, a second twist number, and a second elongation at break that is less than the first elongation at break. The first yarn and the second yarn have the same cord twist. The hybrid fiber cord has a third elongation at break that is greater than the second elongation at break.

In yet another embodiment, a method of manufacturing a hybrid fiber cord, the method includes primarily twisting nylon filaments at a first twist number to produce a nylon primarily-twisted yarn and primarily twisting aramid filaments at a second twist number to produce an aramid primarily-twisted yarn. The method further includes secondarily twisting a first length of the nylon primarily-twisted yarn with a second length of the aramid primarily-twisted yarn, wherein the second length is greater than the first length.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

The term ply yarn as used herein refers to a yarn made by secondarily twisting two or more primarily-twisted yarns together, which may also be called raw cord. The primary twisting may be performed by twisting filaments in a counterclockwise direction, i.e., the Z-direction. The secondary twisting may be performed by twisting the primarily-twisted yarns together in clockwise direction, i.e., the S-direction.

The term fiber cord as used herein refers to a ply yarn containing an adhesive so that it can be applied to a rubber product at firsthand, which may also be called dipped cord. The fiber cord also includes a fabric containing an adhesive, which may be made by weaving a fabric with the ply yarns and then dipping the fabric into an adhesive solution.

The term twist number as used herein refers to the number of twist per 1 inch, and the measure of the twist number is TPI (Twist Per Inch).

Figure 1:
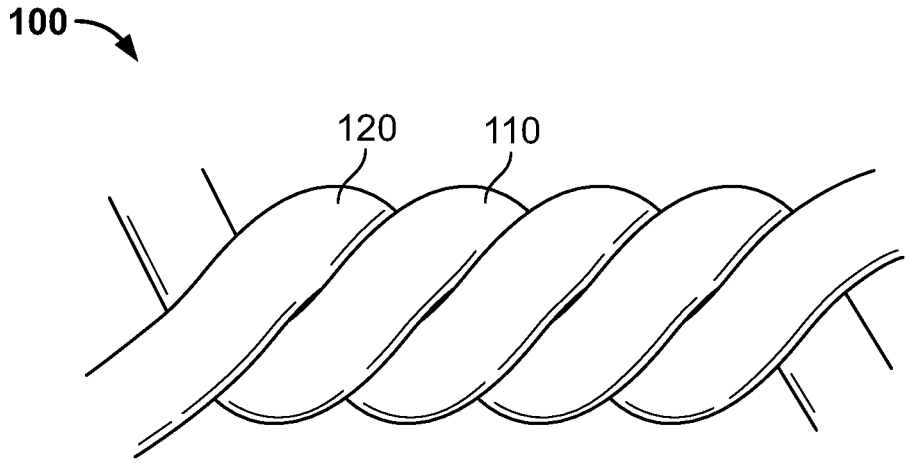
FIG. 1 is a top view of a hybrid fabric cord.

FIG. 1 is a top view of a hybrid fabric cord 100. The hybrid fabric cord 100 includes a nylon yarn 110 and an aramid yarn 120. The nylon yarn 110 and the aramid yarn 120 have the same secondary twist. In alternative embodiments (not shown), the hybrid fabric cord may include any two different yarns. In one known example, the hybrid fabric cord includes a nylon yarn and an aramid yarn. Another contains a polyester yarn and an aramid yarn.

In one embodiment, the hybrid fabric cord 100 is formed by first creating the nylon yarn 110 and the aramid yarn 120. The nylon yarn 110 is formed by twisting nylon filaments in a first direction, such that the nylon yarn 110 has a twist number between 6 and 14 TPI and a denier between 840 and 1890. The resulting nylon yarn 110 also has an elongation at break of between 18-percent and 22-percent.

The aramid yarn 120 is formed by twisting aramid filaments in a first direction (i.e., the same direction as the nylon yarn), such that the aramid yarn 120 has a twist number between 6 and 14 TPI and a denier between 1000 and 3000. The resulting aramid yarn 120 also has an elongation at break of between 4-percent and 6-percent. The aramid yarn 120 has greater strength than the nylon yarn 110, but a lower elongation at break.

In one embodiment, the nylon yarn 110 has the same twist number as the aramid yarn 120. In an alternative embodiment, the nylon yarn has a greater twist number than the aramid yarn. In another alternative embodiment, the nylon yarn has a lesser twist number than the aramid yarn.

The nylon yarn 110 and aramid yarn 120 are then fed into a direct cabler that twists the nylon yarn 110 and aramid yarn 120 together in a second twist direction (i.e., a direction opposite the first twist direction of the nylon filaments and the aramid filaments). In an alternative embodiment, the cabler twists the nylon yarn and the aramid yarn together in the first twist direction (i.e., the same direction as the first twist direction of the nylon filaments and the aramid filaments).

The nylon yarn 110 and the aramid yarn 120 are twisted together such that they each have the same secondary twist. However, the aramid yarn 120 is over fed into the cabler. In other words, the aramid yarn 120 is fed into the cabler at a higher rate (with less stretch) than the nylon yarn 110. As a result, the aramid yarn 120 has a greater length than the nylon yarn 110 in the hybrid fabric cord 100. In one embodiment, the length of the aramid yarn 120 is between 105-percent and 120-percent of the length of the nylon yarn 110. In other words, if a length of the hybrid fabric cord 100 is untwisted, the aramid yarn will be 5-percent to 20-percent longer than the nylon yarn.

The resulting hybrid fiber cord 100 has an elongation at break that is greater than the elongation at break of the aramid yarn 120 alone. In one known embodiment, the hybrid fiber cord 100 has an elongation at break that is greater than the elongation at break of the aramid yarn 120, but less than the elongation at break of the nylon yarn 110. In an alternative embodiment, the hybrid fiber cord 100 has an elongation break that is equal to the elongation at break of the nylon yarn 110. In one known example, the resulting aramid yarn 120 has an elongation at break of between 4-percent and 6-percent.

The hybrid fiber cord 100 has an elongation between 6-percent and 6.5-percent under a tension load of 15 pounds. Additionally, the hybrid fiber cord 100 has an elongation between 4.8-percent and 5.1-percent under a tension load of 10 pounds. The hybrid fiber cord 100 also has an elongation between 2.8-percent and 3-percent under a tension load of 5 pounds.

In one embodiment, the resulting hybrid fiber cord 100 has a tensile strength between 70 lbf and 75 lbf. In alternative embodiments, the resulting hybrid fiber cord has a tensile strength between 65 lbf and 80 lbf. In still other alternative embodiments, the resulting hybrid fiber cord has a tensile strength between 60 lbf and 85 lbf.

Figure 4:
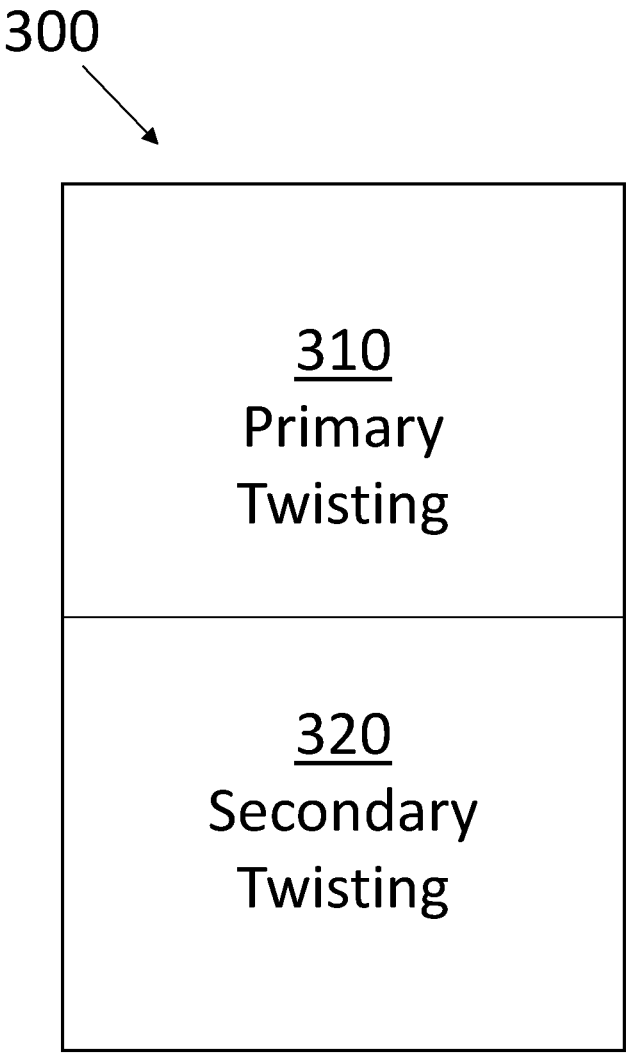
FIG. 4 is a schematic drawing illustrating a one-step machine for twisting filaments and yarn.

In one embodiment, the hybrid fiber cord 100 is made with a one-step machine 300, as shown schematically in FIG. 4. In such an embodiment, the step of primarily twisting the nylon filaments is performed at the same time as the step of primarily twisting the aramid filaments (310). Additionally, the step of secondarily twisting the first length of the nylon primarily-twisted yarn with the second length of the aramid primarily-twisted yarn is performed at the same time as the step of primarily twisting the nylon filaments and primarily twisting the aramid filaments (320). Each of these steps is performed by the same machine.

In an alternative embodiment, multiple machines may be used. For example, the step of primarily twisting the nylon filaments is performed before the step of primarily twisting the aramid filaments. Alternatively, the step of primarily twisting the nylon filaments may be performed after the step of primarily twisting the aramid filaments. In such embodiments, the nylon yarn and the aramid yarn may be formed at the same location or at different locations. For example, the nylon yarn may be made at a first location, the aramid yarn may be made at a second location, and the nylon yarn and aramid yarn may be transported to a third location where they are twisted together into a hybrid fiber cord.

Figure 2:
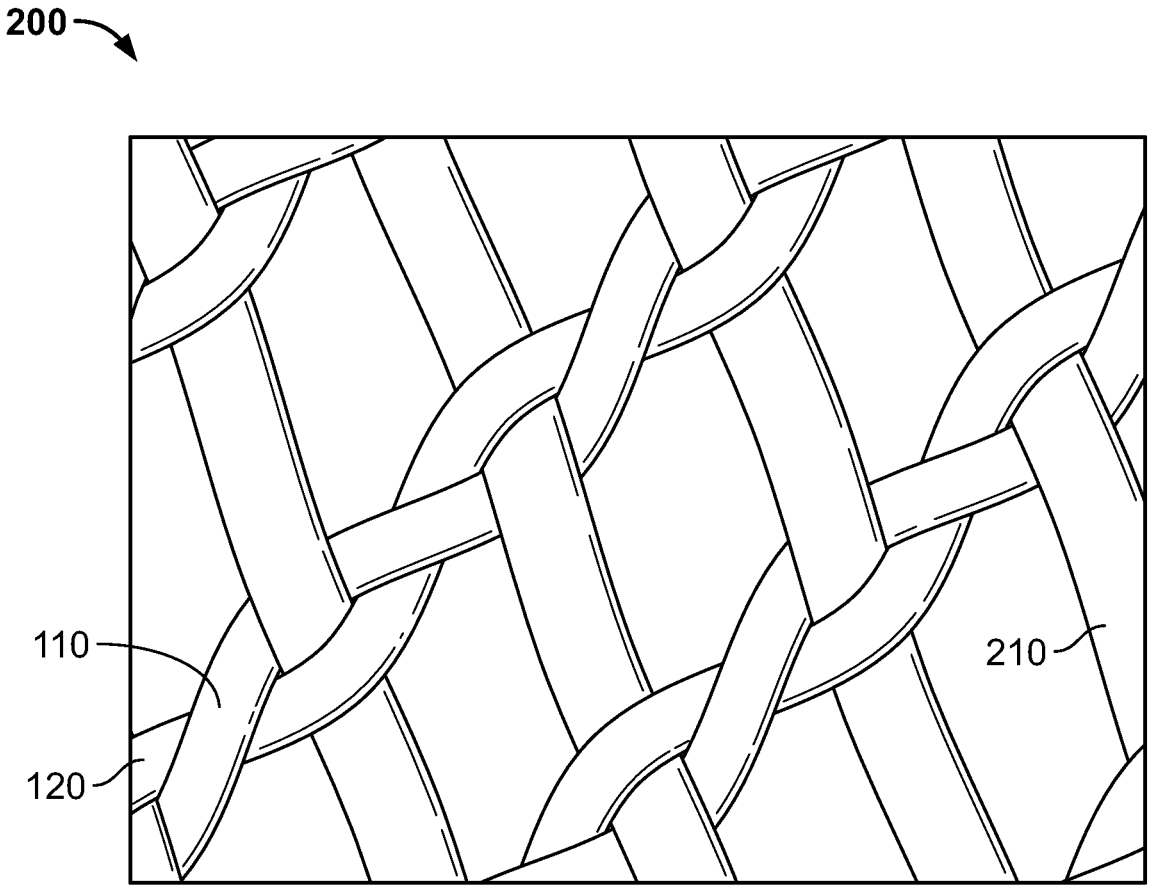
FIG. 2 is a top view of a woven sheet of hybrid fiber cord.

The hybrid fiber cord 100 may be woven into a fabric. FIG. 2 illustrates one embodiment of a leno weave fabric 200. As one of ordinary skill would understand, a leno weave is a weave in which two warp yarns are twisted around the weft yarns to provide a strong yet sheer fabric. The standard warp yarn is paired with a doup yarn. These twisted warp yarns grip tightly to the weft which causes the durability of the fabric. Leno weave produces an open fabric with almost no yarn slippage or misplacement of threads. In this embodiment, the fabric 200 includes a nylon yarn 110 and an aramid yarn 120 as the warp yarns. The fabric 200 further includes a weft yarn 210 that may be constructed of aramid, nylon, or other fibers.

Additional fabrics have been made using a typical tire cord type construction as well as being knitted into a typical 9×9 weft insertion fabric. These have been used as a tire body ply reinforcement as well as a skimless cap ply application.

EXAMPLES

Figure 3:
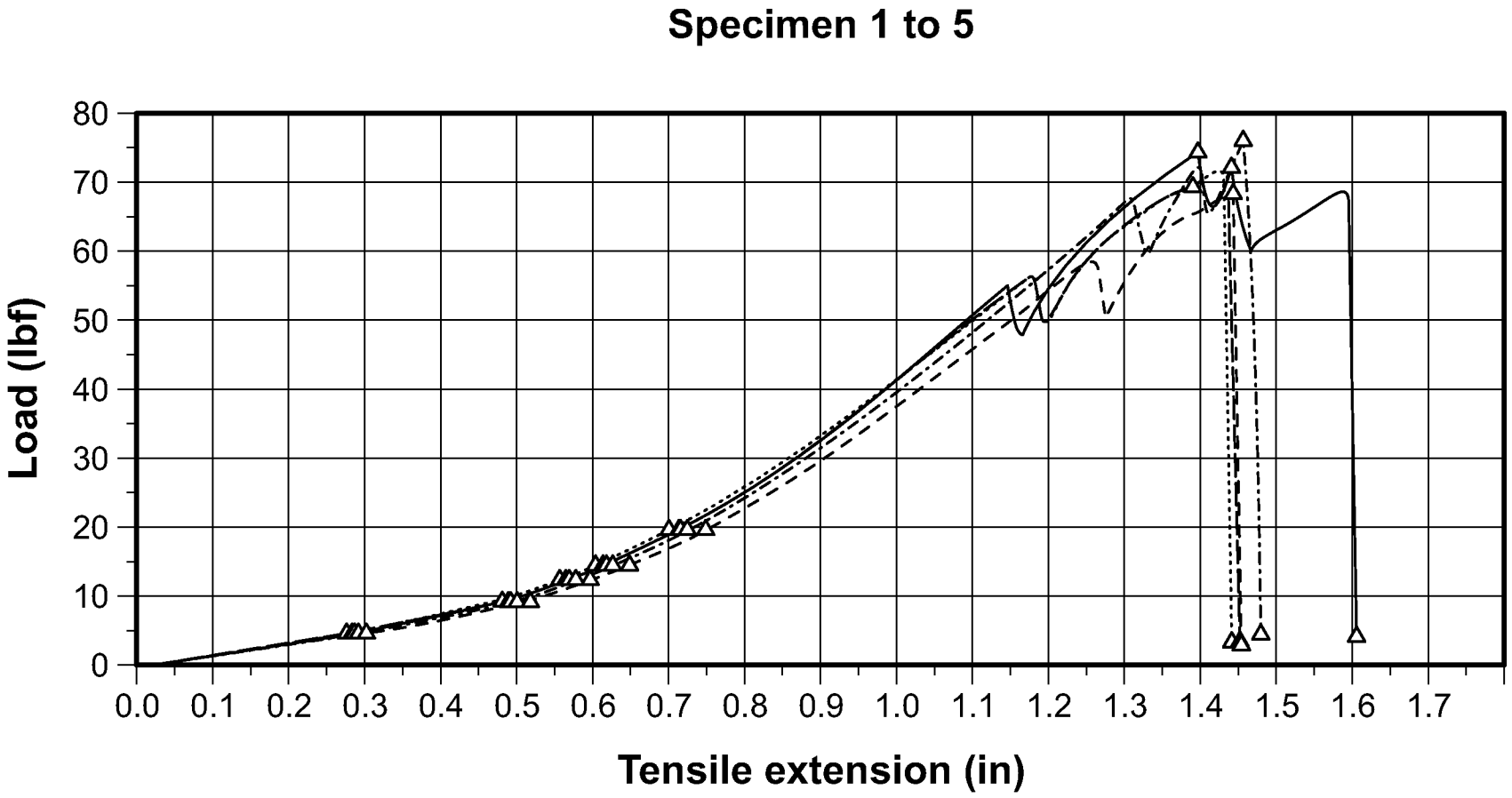
FIG. 3 is a graph depicting tensile extension properties of exemplary hybrid fiber cords.

Exemplary hybrid fiber cords were formed with a nylon yarn and an aramid yarn. The tensile strength of each exemplary hybrid fiber cord was then tested, and elongation was measured at increasing tension as shown in FIG. 3 and recorded in Table 1 below.

TABLE 1

| | Tensile-LB (lbf) | Tensile-N (N) | Ult Elong (%) | Elong @ 5 LB (%) | Elong @ 7.5 LB (%) | Elong @ 10 LB (%) | Elong @ 12.9 LB (%) | Elong @ 15 LB (%) | Elong @ 20 LB (%) |
|---|---|---|---|---|---|---|---|---|---|
| 1 | 74.522 | 331.491 | 14.509 | 2.885 | 4.055 | 4.897 | 5.668 | 6.144 | 7.128 |
| 2 | 72.526 | 322.610 | 14.527 | 2.789 | 3.965 | 4.813 | 5.584 | 6.056 | 6.993 |
| 3 | 69.504 | 309.167 | 14.393 | 2.894 | 4.083 | 4.933 | 5.707 | 6.181 | 7.134 |
| 4 | 76.366 | 339.692 | 14.768 | 2.925 | 4.123 | 4.985 | 5.773 | 6.255 | 7.233 |
| 5 | 69.017 | 307.002 | 16.016 | 3.025 | 4.253 | 5.144 | 5.965 | 6.474 | 7.488 |
| Mean | 72.387 | 321.993 | 14.843 | 2.904 | 4.096 | 4.955 | 5.739 | 6.222 | 7.195 |
| SD | 3.16546 | 14.08067 | 0.66985 | 0.08486 | 0.10543 | 0.12326 | 0.14376 | 0.15801 | 0.18464 |
| Max | 76.366 | 339.692 | 16.016 | 3.025 | 4.253 | 5.144 | 5.965 | 6.474 | 7.488 |
| Min | 69.017 | 307.002 | 14.393 | 2.789 | 3.965 | 4.813 | 5.584 | 6.056 | 6.993 |

Table 1 shows that the exemplary hybrid fiber cords had tensile strength between 69.017 pounds to 76.366 pounds (307.002 N to 339.692 N) and an ultimate elongation between 14.393-percent and 16.016-percent. Table 1 further shows elongation at incremental tensions between 5 and 20 pounds.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative system and method, and illustrative examples shown and described. Accordingly, departures may be made from such details without departing from the spirit or scope of the applicant's general inventive concept.

What is claimed is:

1. A hybrid fiber cord comprising:

a nylon yarn having a first length, a first twist number, a first denier, and a first elongation at break; and an aramid yarn having a second length greater than the first length, a second twist number greater than the first twist number, a second denier greater than the first denier, and a second elongation at break that is less than the first elongation at break, wherein the nylon yarn and the aramid yarn have a same cord twist, wherein the second length is 5% to 20% longer than the first length, and wherein the hybrid fiber cord has a third elongation at break that is greater than the second elongation at break.

2. The hybrid fiber cord of claim 1, wherein the aramid yarn has a denier between 1400 and 1600.

3. The hybrid fiber cord of claim 1, wherein the nylon yarn has a denier between 1100 and 1300.

4. The hybrid fiber cord of claim 1, wherein the hybrid fiber cord has a tensile strength between 70 lbf and 75 lbf.

5. The hybrid fiber cord of claim 1, wherein the hybrid fiber cord has an ultimate elongation between 14-percent and 16-percent.

6. The hybrid fiber cord of claim 1, wherein the hybrid fiber cord has an elongation between 6-percent and 6.5-percent under a tension load of 15 pounds.

7. A hybrid fiber cord comprising:

a first yarn having a first length, a first twist number, a first denier, and a first elongation at break; and a second yarn having a second length greater than the first length, a second twist number greater than the first twist number, a second denier greater than the first denier, and a second elongation at break that is less than the first elongation at break, wherein the first yarn and the second yarn have a same cord twist, and wherein the hybrid fiber cord has a third elongation at break that is greater than the second elongation at break.

8. The hybrid fiber cord of claim 7, wherein the second length is 5% to 20% longer than the first length.

9. The hybrid fiber cord of claim 7, wherein the hybrid fiber cord has an elongation between 4.8-percent and 5.1-percent under a tension load of 10 pounds.

10. The hybrid fiber cord of claim 7, wherein the hybrid fiber cord has an elongation between 2.8-percent and 3-percent under a tension load of 5 pounds.

11. The hybrid fiber cord of claim 7, wherein the first yarn is constructed of nylon.

12. The hybrid fiber cord of claim 11, wherein the second yarn is constructed of a material selected from the group consisting of aramid and polyester.

13. A method of manufacturing a hybrid fiber cord, the method comprising:

primarily twisting nylon filaments at a first twist number to produce a nylon primarily-twisted yarn having a first denier;

primarily twisting aramid filaments at a second twist number greater than the first twist number, to produce an aramid primarily-twisted yarn having a second denier greater than the first denier; and secondarily twisting a first length of the nylon primarily-twisted yarn with a second length of the aramid primarily-twisted yarn, wherein the second length is greater than the first length.

14. The method of claim 13, wherein the second length is 5% to 20% longer than the first length.

15. The method of claim 13, wherein the step of primarily twisting the nylon filaments is performed at the same time as the step of primarily twisting the aramid filaments.

16. The method of claim 15, wherein the step of secondarily twisting the first length of the nylon primarily-twisted yarn with the second length of the aramid primarily-twisted yarn is performed at the same time as the step of primarily twisting the nylon filaments and primarily twisting the aramid filaments.

17. The method of claim 13, wherein a single machine performs the steps of primarily twisting the nylon filaments, primarily twisting the aramid filaments, and secondarily twisting the first length of the nylon primarily-twisted yarn with the second length of the aramid primarily-twisted yarn.

* * * * *